US008820197B2

(12) United States Patent
Wu

(10) Patent No.: US 8,820,197 B2
(45) Date of Patent: Sep. 2, 2014

(54) HAND TOOL WITH REPLACEMENT HANDLE

(75) Inventor: Ming-Chia Wu, Tainan (TW)

(73) Assignee: Gong Fong Enterprise Co., Ltd., Tainan (TW)

( * ) Notice: Subject to any disclaimer, the term of this patent is extended or adjusted under 35 U.S.C. 154(b) by 259 days.

(21) Appl. No.: 13/517,666

(22) Filed: Jun. 14, 2012

(65) Prior Publication Data

US 2013/0333530 A1 Dec. 19, 2013

(51) Int. Cl.

| | |
|---|---|
| ***B25G 1/06*** | (2006.01) |
| ***B25G 1/08*** | (2006.01) |
| ***B25G 1/04*** | (2006.01) |

(52) U.S. Cl.

CPC ... *B25G 1/06* (2013.01); *B25G 1/04* (2013.01)

USPC ..... 81/177.7; 81/490

(58) Field of Classification Search

USPC ..... 81/177.6, 177.7, 177.4, 177.8, 177.9, 81/490

See application file for complete search history.

(56) References Cited

U.S. PATENT DOCUMENTS

| | | | | |
|---|---|---|---|---|
| 2,518,139 | A * | 8/1950 | Hallowell et al. | 279/75 |
| 5,329,834 | A * | 7/1994 | Wong | 81/58.3 |
| 5,515,754 | A * | 5/1996 | Elkins | 81/177.9 |
| 5,517,884 | A * | 5/1996 | Sanders | 81/60 |
| 5,816,119 | A * | 10/1998 | Herue | 81/60 |
| 6,189,420 | B1 * | 2/2001 | Shiao | 81/60 |
| 6,298,755 | B1 * | 10/2001 | England | 81/438 |
| 6,634,262 | B2 * | 10/2003 | Malchus | 81/490 |
| 7,069,828 | B2 * | 7/2006 | Huang | 81/489 |
| 7,481,135 | B2 * | 1/2009 | Schoenbeck et al. | 81/177.7 |
| 8,209,818 | B2 * | 7/2012 | Lin | 16/436 |
| 8,397,607 | B2 * | 3/2013 | Huang | 81/177.8 |
| 8,402,865 | B2 * | 3/2013 | Lin | 81/177.9 |
| 2009/0314140 | A1 * | 12/2009 | Lu | 81/177.4 |

* cited by examiner

*Primary Examiner* — David B Thomas

(74) *Attorney, Agent, or Firm* — Rosenberg, Klein & Lee

(57) ABSTRACT

A hand tool includes a body having a first space in which a first threaded portion and a non-circular positioning portion are located. A handle is threadedly connected to the body and has a pivotal member pivotably connected thereto. The pivotal member has a second threaded portion which is connected to the first threaded portion. A slot is defined in the second threaded portion and a push member is located in the slot. The push member has a non-circular positioning member which is in contact with the positioning portion. The handle further has a room to which an end cap is threadedly connected.

8 Claims, 7 Drawing Sheets

B - B

HAND TOOL WITH REPLACEMENT HANDLE

FIELD OF THE INVENTION

The present invention relates to a hand tool, and more particularly, to a hand tool with a replacement handle. The handle and the body of the hand tool are two separated parts and assembled to each other.

BACKGROUND OF THE INVENTION

The conventional hand tool such as the screw driver disclosed in Taiwan Patent Publication No. M358699 discloses a body which has an installation end and a connection end to which a handle is pivotably connected. The body has a room for accommodating a box therein. When the hand tool is not in use, the handle is received in the room and the handle can be pivoted outward when in use.

Taiwan Patent Publication No. M274211 discloses a handle composed of a front section and a rear section. The front section has a screw bit connected to a front end thereof and the rear section has a positioning device. The positioning device has a positioning pin slidably connected to the rear section and the positioning pin is biased toward the front section by a spring. The positioning pin is engaged with one of positioning recesses in the front section to set the relative position between the front and rear sections. The rear section has a push member on one side thereof and the push member has the first end pivotably connected to the positioning pin and the second end of the push member is formed as a push portion so that the user pushes the push member to move the positioning pin by one hand. By engaging or disengaging the positioning pin with the positioning recesses, the angle between the front and rear sections can be set and adjusted.

However, the two known hand tools can only adjust the angle between the front and rear sections, the front section cannot be separated from the rear section. Therefore, when different lengths of the handle are needed, the two known hand tools cannot provide the specific function.

The present invention intends to provide a hand tool that can be connected with the handle with different lengths.

SUMMARY OF THE INVENTION

The present invention relates to a hand tool and comprises a body having a first space and a first threaded portion is defined in the inner periphery of the first space. A non-circular positioning portion is located in the first space. A handle is threadedly connected to the body and has a pivotal member pivotably connected thereto. The pivotal member has a second threaded portion which is located corresponding to the first threaded portion. A slot is defined in the second threaded portion and a push member is located in the slot. The push member has a non-circular positioning member which is in contact with the positioning portion. The hand tool can be connected with the handle with different lengths.

Preferably, the handle has a room and an end cap is threadedly engaged with the room. The end cap has a third threaded portion.

Preferably, the positioning portion and the positioning member are hexagonal-shaped.

Preferably, the pivotal member has multiple engaging recesses and the handle has an engaging member located therein. The engaging member is engaged with one of the engaging recesses.

The primary object of the present invention is to provide a hand tool which can be connected with the handle with different lengths as needed.

The body can be set at an angle relative to the handle to reach desired positions where the objects are located.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
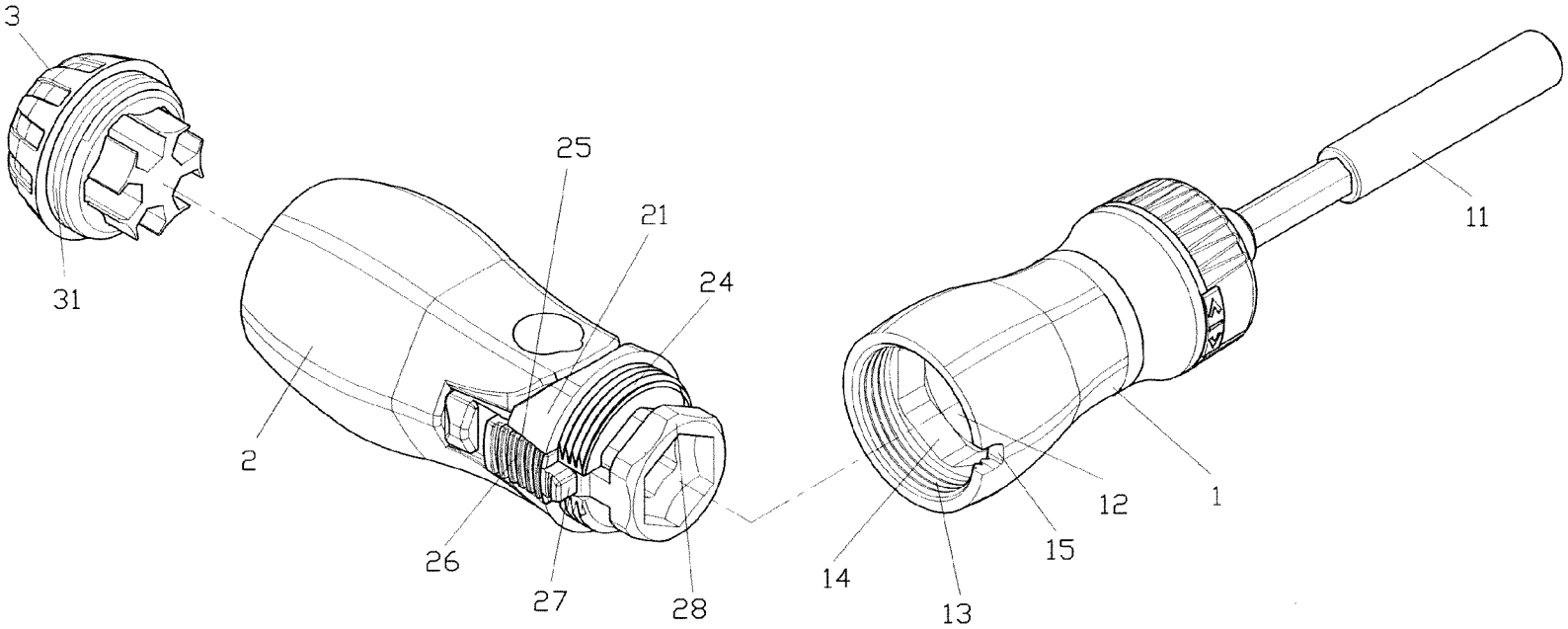
FIG. 1 is an exploded view to show the hand tool of the present invention.
Figure 2:
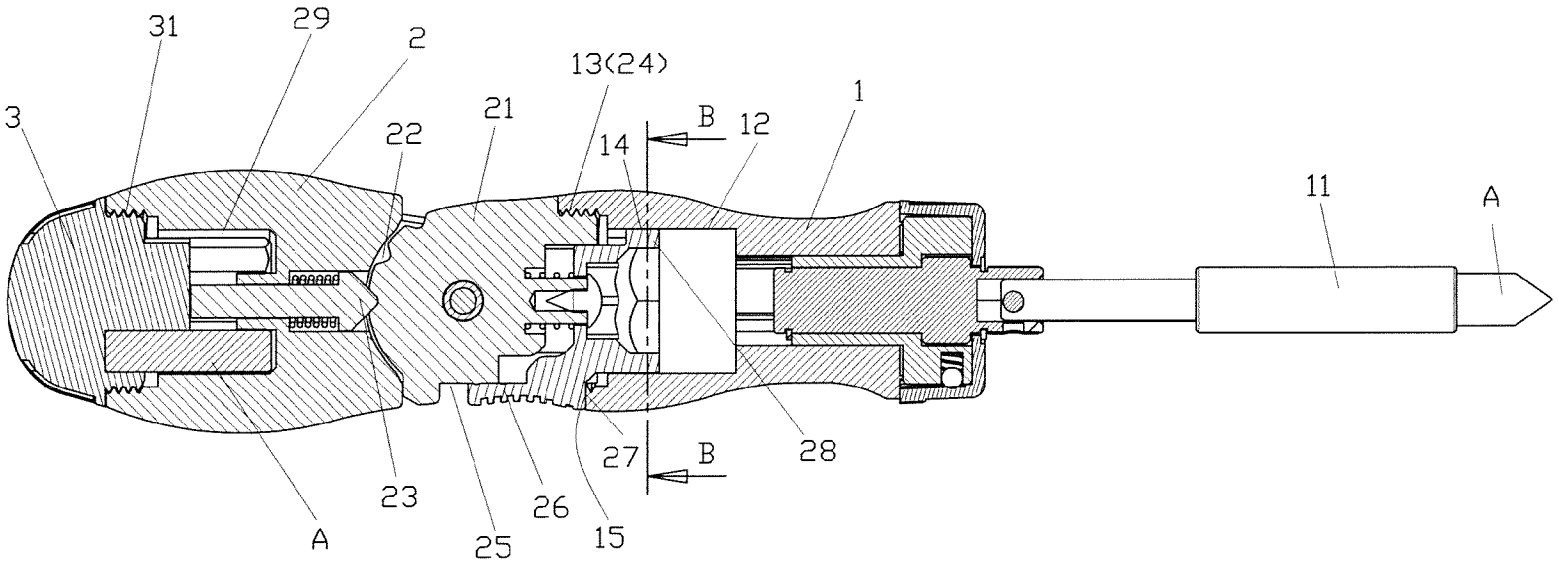
FIG. 2 is a cross sectional view of the hand tool of the present invention.

Referring to FIGS. 1 and 2, the hand tool of the present invention comprises a body 1, a handle 2 and an end cap 3. The body 1 has a first space 12 and a first threaded portion 13 is defined in the inner periphery of the first space 12. A non-circular positioning portion 14 is located in the first space 12 and the non-circular positioning portion 14 is hexagonal. The first threaded portion 13 has a notch 15.

Figure 3:
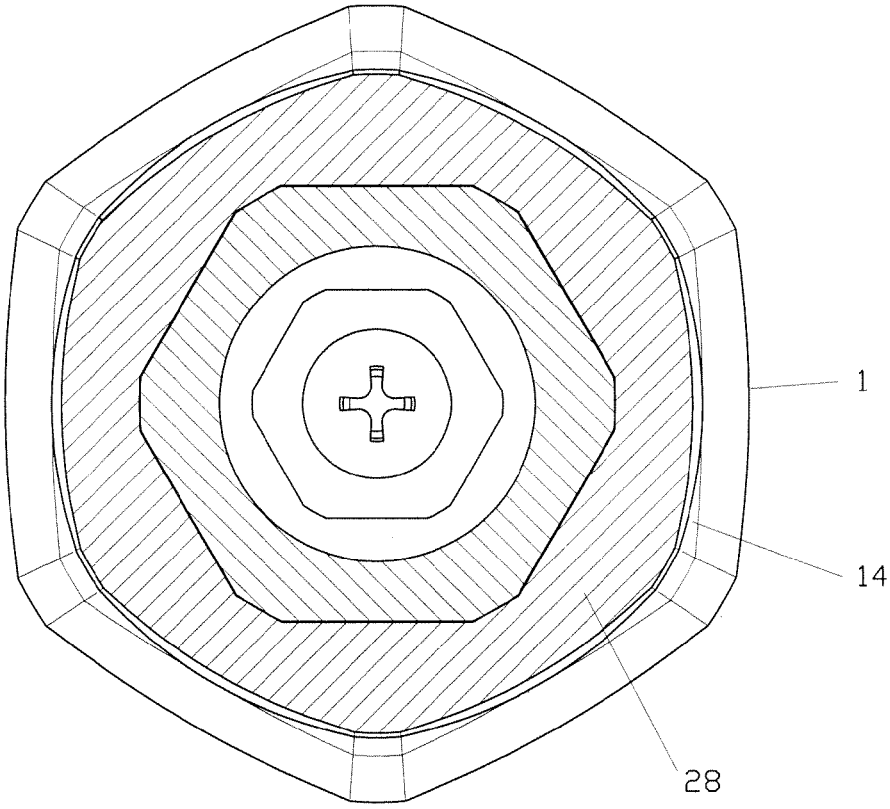
FIG. 3 is a cross sectional view, taken along line B-B of FIG. 2.

The handle 2 is threadedly connected to the body 1 and has a pivotal member 21 pivotably connected thereto. The pivotal member 21 has multiple engaging recesses 22 and the handle 2 has an engaging member 23 located therein. The engaging member 23 is retractably engaged with one of the engaging recesses 22. The handle 2 has a second threaded portion 24 which is located corresponding to and threadedly connected to the first threaded portion 13. A slot 25 is defined in the second threaded portion 24 and a push member 26 is located in the slot 25. The push member 26 can be resiliently pushed inward and has a protrusion 27 which is engaged with the notch 15. The push member 26 has a non-circular positioning member 28 which is a hexagonal member and in contact with the positioning portion 14 as shown in FIGS. 2 and 3.

The handle 2 has a room 29 and the end cap 3 is threadedly engaged with the room 29. The end cap 3 has a third threaded portion 31.

As shown in FIG. 2, when the hand tool is used as a long-handle tool, the extension tube 11 on the body 1 is connected with a screw bit "A" and the user holds the handle 2 and rotates the handle 2 to rotate the pivotal member 21 and the body 1. The positioning member 28 is engaged with the positioning portion 14 of the body 1 so that it is rotated with the body 1. When the body 1 is rotated, the extension tube 11 and the screw bit "A" are rotated to tighten or loosened the object.

Figure 4:
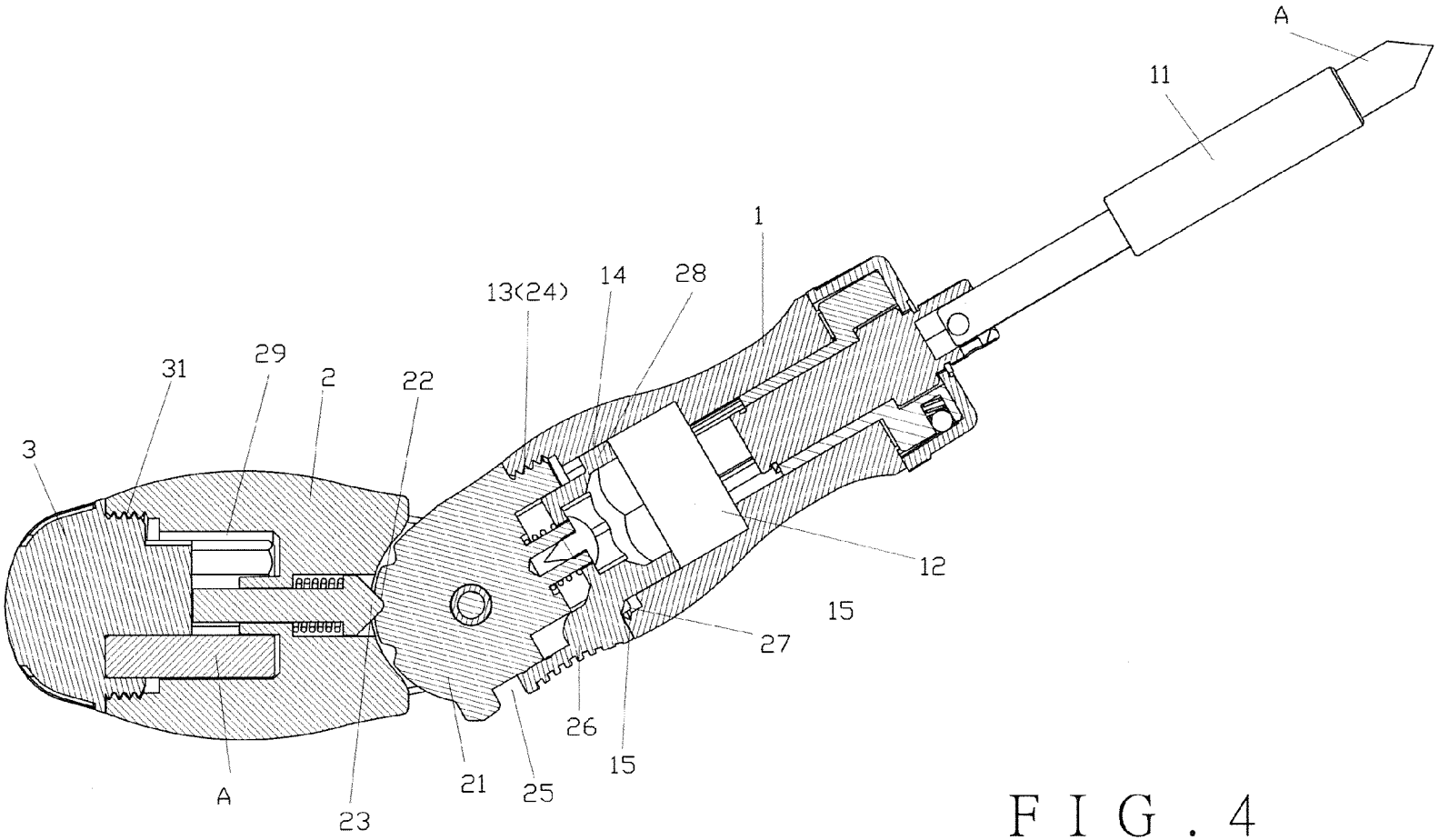
FIG. 4 shows that the body of the present invention is set at angle relative to the handle.

When the body 1 is needed to be set at angle, as shown in FIG. 4, the pivotal member 21 is rotated relative to the handle 2, the pivotal member 21 compresses the engaging member 23. When the desired angle is reached, the engaging member 23 bounces and is engaged with the engaging recess 22 to set the position. The pivotal movement of the pivotal member 21 rotates the body 1 to set the body 1 at the desired position.

Figure 5:
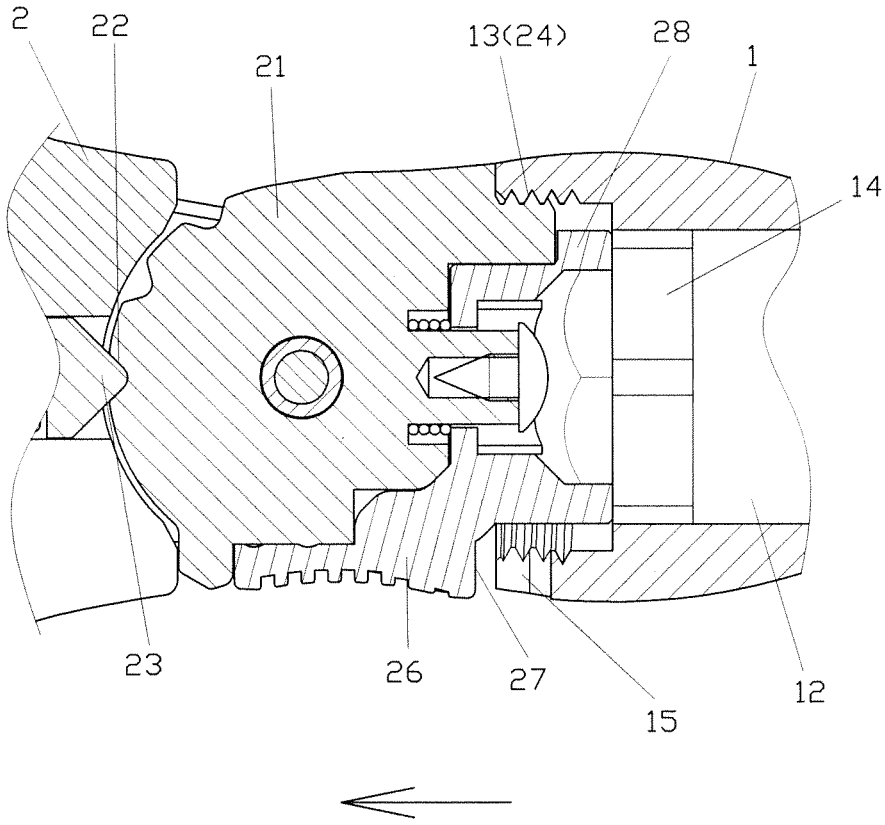
FIG. 5 shows that the push member is pushed.
Figure 6:
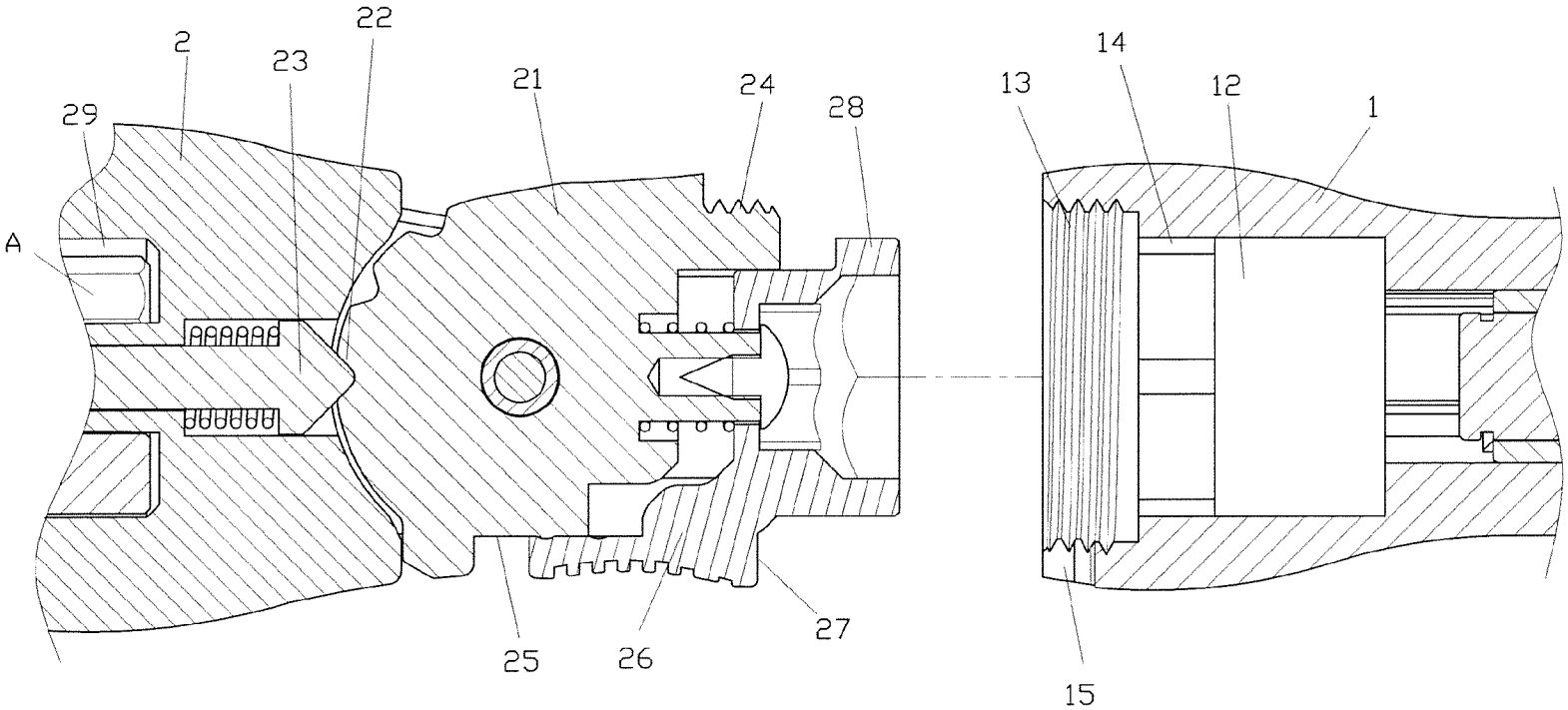
FIG. 6 shows that the body and the handle are separated from each other.
Figure 7:
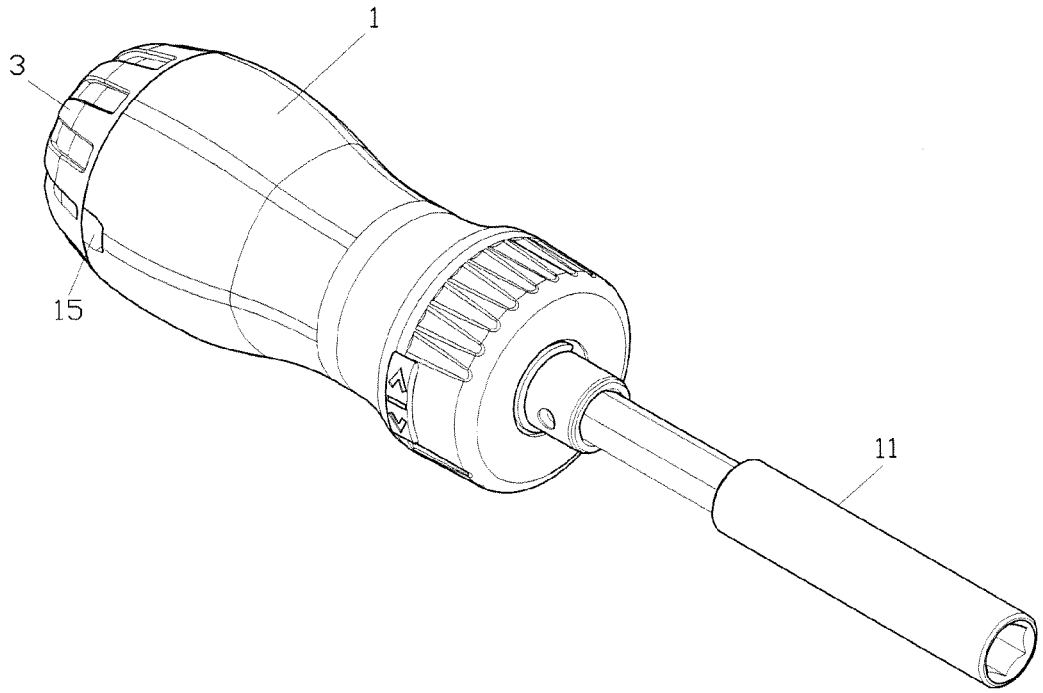
FIG. 7 shows that the hand tool is used as a short-handle tool.

As shown in FIGS. 5 and 6, when the hand tool is used as a short-handle tool, the push member 26 is pushed within the slot 25 so that the protrusion 27 of the push member 26 is disengaged from the notch 15. The positioning member 28 of the push member 26 is removed from the positioning portion 14. Therefore, the handle 2 and the body 1 are separated from each other by unscrewing the second threaded potion 24 of the pivotal member 21 from the first threaded portion 13 of the body 1. The end cap 3 is then loosened and then connected to the body 1 by the engagement between the first and third threaded portions 13, 23 as shown in FIG. 7. Therefore, the hand tool is used as a short-handle tool.

While we have shown and described the embodiment in accordance with the present invention, it should be clear to those skilled in the art that further embodiments may be made without departing from the scope of the present invention.

What is claimed is:

1. A hand tool comprising:

a body having a first space and a first threaded portion defined in an inner periphery of the first space, a non-circular positioning portion located in the first space, and a handle threadedly connected to the body and having a pivotal member pivotably connected thereto, the pivotal member having a second threaded portion which is located corresponding to the first threaded portion, a slot defined in the second threaded portion and a push member located in the slot, the push member having a non-circular positioning member which is in contact with the positioning portion.

2. The hand tool as claimed in claim 1, wherein the handle has a room and an end cap is threadedly engaged with the room, the end cap has a third threaded portion.

3. The hand tool as claimed in claim 1, wherein the positioning portion and the positioning member are hexagonal-shaped.

4. The hand tool as claimed in claim 1, wherein the pivotal member has a plurality of engaging recesses and the handle has an engaging member located therein, the engaging member is engaged with one of the engaging recesses.

5. The hand tool as claimed in claim 1, wherein the first threaded portion has a notch and the push member has a protrusion which is engaged with the notch.

6. The hand tool as claimed in claim 5, wherein the handle has a room and an end cap is threadedly engaged with the room, the end cap has a third threaded portion.

7. The hand tool as claimed in claim 5, wherein the positioning portion and the positioning member are hexagonal-shaped.

8. The hand tool as claimed in claim 5, wherein the pivotal member has a plurality of engaging recesses and the handle has an engaging member located therein, the engaging member is engaged with one of the engaging recesses.

* * * * *